US006812843B2

(12) United States Patent
Soto et al.

(10) Patent No.: US 6,812,843 B2
(45) Date of Patent: Nov. 2, 2004

(54) AUTO-PHASING SYNCHRONIZATION FOR PULSED ELECTRONIC ARTICLE SURVEILLANCE SYSTEMS

(75) Inventors: Manuel A. Soto, Lake Worth, FL (US); Adam S. Bergman, Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 10/095,546

(22) Filed: Mar. 11, 2002

(65) Prior Publication Data

US 2003/0169168 A1 Sep. 11, 2003

(51) Int. Cl.[7] ..... G08B 13/14
(52) U.S. Cl. ..... 340/572.4; 340/310.04
(58) Field of Search ..... 340/572.4, 572.1, 340/310.01, 310.03, 310.04, 3.2, 825.57, 825.64; 375/259, 354, 362, 371

(56) References Cited

U.S. PATENT DOCUMENTS

| | | | | |
|---|---|---|---|---|
| 4,622,543 A | | 11/1986 | Anderson et al. | 340/572 |
| 4,667,185 A | * | 5/1987 | Nourse et al. | 340/572.1 |
| 5,023,600 A | | 6/1991 | Szklany et al. | 340/572 |
| 5,995,002 A | * | 11/1999 | Fallin et al. | 340/572.1 X |
| 6,118,378 A | | 9/2000 | Balch et al. | 340/572.7 |
| 6,201,469 B1 | | 3/2001 | Balch et al. | 340/10.1 |
| 6,320,507 B1 | * | 11/2001 | Strzelec et al. | 340/572.1 |
| 2002/0135480 A1 | * | 9/2002 | Frederick et al. | 340/572.1 |

* cited by examiner

*Primary Examiner*—Thomas J. Mullen, Jr.

(57) ABSTRACT

Automatic phase adjustment of a pulsed electronic article surveillance transmitter is provided. Amplitude sampling of a received signal is used to detect the leading edge of a interfering transmit pulse and a corresponding delay is calculated for synchronizing the instant transmitter to the interfering transmitter. Detection of EAS tags placed too close to the EAS transmitter interrogation zone is also provided. An alarm can be implemented to indicate detected EAS tags that are placed too close to the interrogation zone.

10 Claims, 4 Drawing Sheets

AUTO-PHASING SYNCHRONIZATION FOR PULSED ELECTRONIC ARTICLE SURVEILLANCE SYSTEMS

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to the operation of multiple electronic article surveillance (EAS) systems, and more particularly to the automatic synchronization of EAS systems operating in proximity to each other.

2. Description of the Related Art

Pulsed magnetic EAS systems, such as disclosed in U.S. Pat. Nos. 6,118,378, and 4,622,543, typically operate by generating a short burst of magnetic flux in the vicinity of a transmitter antenna. This pulsed field stimulates a particular type of magnetic label or marker, whose characteristics are such that it is resonant at the operating frequency of the system. The marker absorbs energy from the field and begins to vibrate at the transmitter frequency. This is known as the marker's forced response. When the transmitter stops abruptly, the marker continues to ring down at a frequency, which is at, or very near the system's operating frequency. This ring down frequency is known as the marker's natural frequency. The vicinity of the transmitter antenna in which the response can be forced is the interrogation zone of the EAS system.

The magnetic marker is constructed such that when the marker rings down, the marker produces a weak magnetic field, alternating at the marker's natural frequency. The EAS system's receiver antenna, which may be located either within its own enclosure or within the same enclosure as the transmitter antenna, receives the marker's ring down signal. The EAS system processes the marker's unique signature to distinguish the marker from other electromagnetic sources and/or noise, which may also be present in the interrogation zone. A validation process must therefore be initiated and completed before an alarm sequence can be reliably generated to indicate the marker's presence within the interrogation zone.

The validation process is time-critical. The transmitter and receiver gating must occur in sequence and at predictable times. Typically, the gating sequence starts with the transmitter burst starting with a synchronizing source, such as the local power line's zero crossing. The receiver window opens at some predetermined time after the same zero crossing. Problems arise when the transmitter and receiver are not connected to the same power source. In a three phase power system, power lines within a building can have individual zero crossings at 0 degrees, 120 degrees or 240 degrees with respect to each other.

Some noise sources are synchronous with the local power line. Televisions, monitors, cathode ray tube in other devices, electric motors, motor controllers and lamp dimmers, for example, all generate various forms of line synchronous noise. As a result, no one-time window can be guaranteed to be suitable for detecting markers.

Accordingly, pulsed magnetic EAS receivers typically examine three time windows to scan for the presence of magnetic markers. With a 60 Hz power line frequency, for example, the first window occurs nominally 2 milliseconds (msec) after the receiver's local positive zero crossing, by convention referred to as phase A. The second receiver window, referred to as phase B, occurs 7.55 msec after the local zero crossing, which is determined by adding one-third of the line frequency period and 2 msec. The third receiver window, referred to as phase C, occurs 13.1 msec after the local zero crossing, which is determined by adding two-thirds of the line frequency period and 2 msec. At 50 Hz power line frequencies, the timing is analogous. Each receiver window begins a nominal 2 msec after either the 0 degree, 120 degree, or 240 degree point in the line frequency's period. In this way, if a first EAS system, referred to as system A, is connected to a different phase of the power line than a nearby EAS system, referred to as system B, the transmitted signal of system B will not directly interfere with the receiver of system A.

In order to compare received signals to background noise, separate noise averages are continuously sampled, computed and stored as part of a signal processing algorithm. This is commonly done by operating the EAS systems at 1.5 times the power line frequency, 90 Hz for a 60 Hz line frequency or 75 Hz for a 50 Hz line frequency, and alternating the interpretation of each successive phase. More particularly, if phase A is a transmit phase (the receiver window is preceded by a transmitter burst), phase B will be a noise check phase (the receiver window was not preceded by a transmitter burst), phase C will be a transmit phase, phase A will be a noise check phase, and so on.

Even if the EAS systems are transmitting on the same phase, independent pulsed magnetic EAS systems operating near each other can have a degrading influence on each other. Two or more pulsed EAS systems are considered near each other if they can interfere with one another if not synchronized in one fashion or another. Pulsed EAS systems positioned within hundreds of feet of one another must have their transmit burst timing precisely aligned or the transmitters will interfere with one another's receivers, decreasing sensitivity or causing false alarms. In prior systems this has been accomplished by using the three phases of the power line for synchronization. Each system is plugged into the 60 (or 50) hertz power system, which is divided into three phases, as described above. Each phase is a sinusoidal function nominally offset from one another by 1/180 of a second (or 1/150 of a second for 50 hertz systems) apart. The zero crossing of the power line is used as a timing reference, assuming that this 1/180 second separation is correct. However, due to variations of loading conditions across the three phases of the power line, often they are not exactly spaced 1/180 seconds apart. Assume, for example, a situation where two independent EAS systems are installed near each other, one system transmits in phase A and the other system also transmits in phase A, but delayed in time with respect to the first system. The first system could sense the transmitter of the second system during its receive window. Thus, two systems near to each other, which may be phase synchronized, can still inhibit each other. This in turn causes a service call to local technicians. The technicians must come and manually adjust the timing of the systems. If loading conditions on the power lines change, the process repeats itself at great expense to the company.

"Other automatic wireless synchronization solution techniques, for example using multiple phase locked loops to remove phase variation in the power line zero crossings, require additional hardware such as a digital signal processors for implementation. An automatic synchronization technique is desired, which adjusts phase timing without requiring additional hardware, thus reducing the cost and time of installation."

BRIEF SUMMARY OF THE INVENTION

"The present invention provides automatic phase adjustment of an EAS transmitter by using amplitude to detect the leading edge of an interfering transmit pulse and calculating a corresponding delay needed for synchronizing its own transmitter to the interfering transmitter. The phasing of a pulsed EAS system consists of synchronizing the transmitter pulse of all adjacent pulsed EAS systems so that all systems transmit simultaneously and no interference can be detected from adjacent transmitters. Each individual system uses its power line zero crossing as a reference for transmitting. Since this zero crossing can vary between system locations a zero crossing delay needs to be added between the power line zero crossing and the transmitter pulse. If the phasing is performed correctly, the addition of the zero crossing delay should synchronize a transmitter pulse with other transmitter pulses successfully.

In a first aspect, a method and system for automatic phase adjustment for synchronizing a pulsed electronic article surveillance system transmitter to an interfering transmitter includes: 1) detecting a signal in a preselected frequency range; 2) comparing the detected signal to a threshold value; 3) incrementing a counter value if the detected signal is greater than the threshold value; 4) comparing a timer value to a preselected sample period; and, 5) if the timer value has reached the preselected sample period, comparing the counter value to a preset value and if the counter value is greater than the preset value the signal includes a valid pulse rate indicating the signal includes an interfering transmitter and/or an electronic article surveillance tag response.

The method and system can further include switching the pulsed electronic article surveillance system transmitter off and repeating steps 1) through 5). If the counter value is greater than the preset value the signal includes a valid pulse rate indicating the signal includes an interfering transmitter; if the counter value is not greater than the preset value the signal does not include a valid pulse rate, indicating the signal does not include an interfering transmitter and normal electronic article surveillance system operation resumes.

The method and system can further include: 1) switching the pulsed electronic article surveillance system transmitter off; 2) setting the threshold value just above the noise floor; 3) moving a line synchronization delay until the detected signal is below the threshold value; 4) moving the line synchronization delay until the detected signal is initially greater than the threshold value to detect a leading edge of the interfering transmitter pulse; 5) storing the line synchronization delay for the leading edge of the interfering transmitter pulse; and, 6) synchronizing the pulsed electronic article surveillance system transmitter to the stored line synchronization delay and returning to normal operation. Synchronizing the transmitter means the leading edge of the transmit pulse will be synchronized to the leading edge of the detected interfering transmitter.

In a second aspect, a method and system for determining if a signal detected by a pulsed electronic article surveillance system transmitter is due to an interfering transmitter or an electronic article surveillance tag, including: 1) detecting a signal in a preselected frequency range; 2) comparing the detected signal to a threshold value; 3) incrementing a counter value if the detected signal is greater than the threshold value; 4) comparing a timer value to a preselected sample period; 5) if the timer value has reached the preselected sample period, comparing the counter value to a preset value and if the counter value is greater than the preset value said the signal includes a valid pulse rate, where the detected signal includes at least one of the interfering transmitter, an electronic article surveillance tag response, or a combination thereof; 6) switching the pulsed electronic article surveillance system transmitter off; and, 7) repeating steps 1) through 5) and if the counter value is greater than the preset value the signal includes a valid pulse rate, where the signal includes an interfering transmitter, if the counter value is not greater than the preset value the signal does not include a valid pulse rate, where the signal does not include an interfering transmitter and then generating a tags too close signal to indicate that the detected signal is due to an electronic article surveillance tag, and resuming normal electronic article surveillance system operation.

Objectives, advantages, and applications of the present invention will be made apparent by the following detailed description of embodiments of the invention.

DETAILED DESCRIPTION OF THE INVENTION

Figure 1:
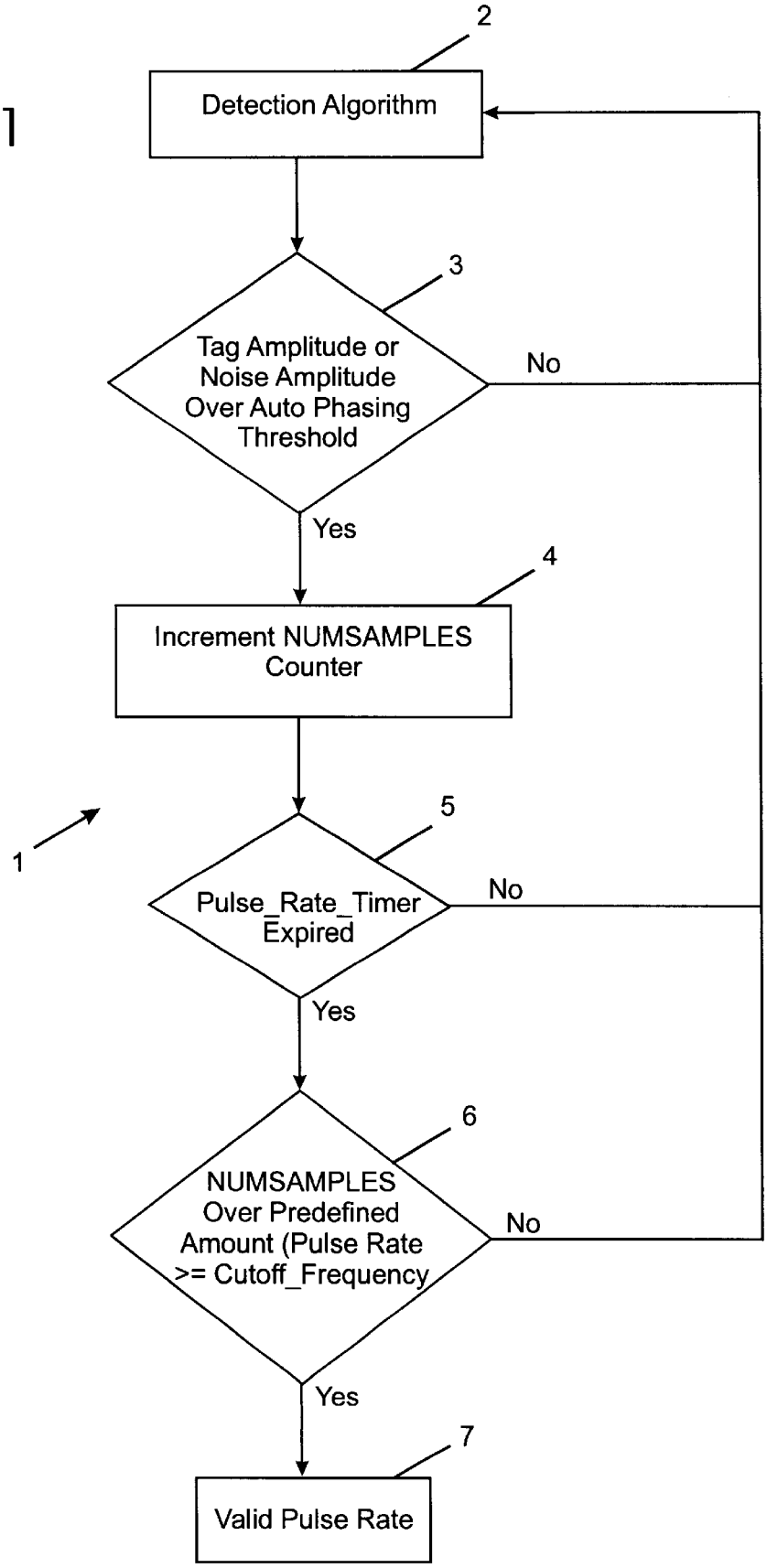
FIG. 1 is a block diagram of the pulse rate detector.

Referring to FIG. 1, the pulse rate detector 1 detects transmitter pulses inside a predefined frequency range. The lower range of the frequency represents the lowest transmitter repetition rate transmitted by any EAS system of interest. The detection algorithm 2 is a conventional receiver detector that is used in a pulsed EAS system to detect EAS markers, such as disclosed in U.S. Pat. No. 6,118,378, the disclosure of which is incorporated herein by reference, and as sold by Sensormatic Electronics Corporation under the trademark ULTRA*POST. The pulse rate detector uses a dynamic amplitude threshold called the auto phase threshold, which is slightly above ambient or nominal noise levels. During normal operation, all receiver amplitudes detected, whether tag or noise, are compared to the auto phase threshold at 3. If a detected signal is above the threshold then a counter, NumSamples, is incremented at 4. After a predetermined amount of time, as determined by timer PulseRateTimer, has elapsed at 5, the counter value, NumSamples, is compared to a preselected number, Tx_Rate. Tx_Rate represents the cutoff frequency for the EAS transmitter pulse, and is calculated as follows:

$$Tx_Rate = Pulse_Rate_Timer(sec)/(1/Cutoff_frequency(Hz))$$

The cutoff frequency represents the lowest frequency repetition rate transmitted by the EAS system of interest, for example, 45 Hz. If the value of the NumSamples counter is higher than Tx_Rate at 6, then it is determined that a valid pulse rate was detected at 7, otherwise normal operation will continue and the process is repeated after all counters has been cleared.

Figure 2:
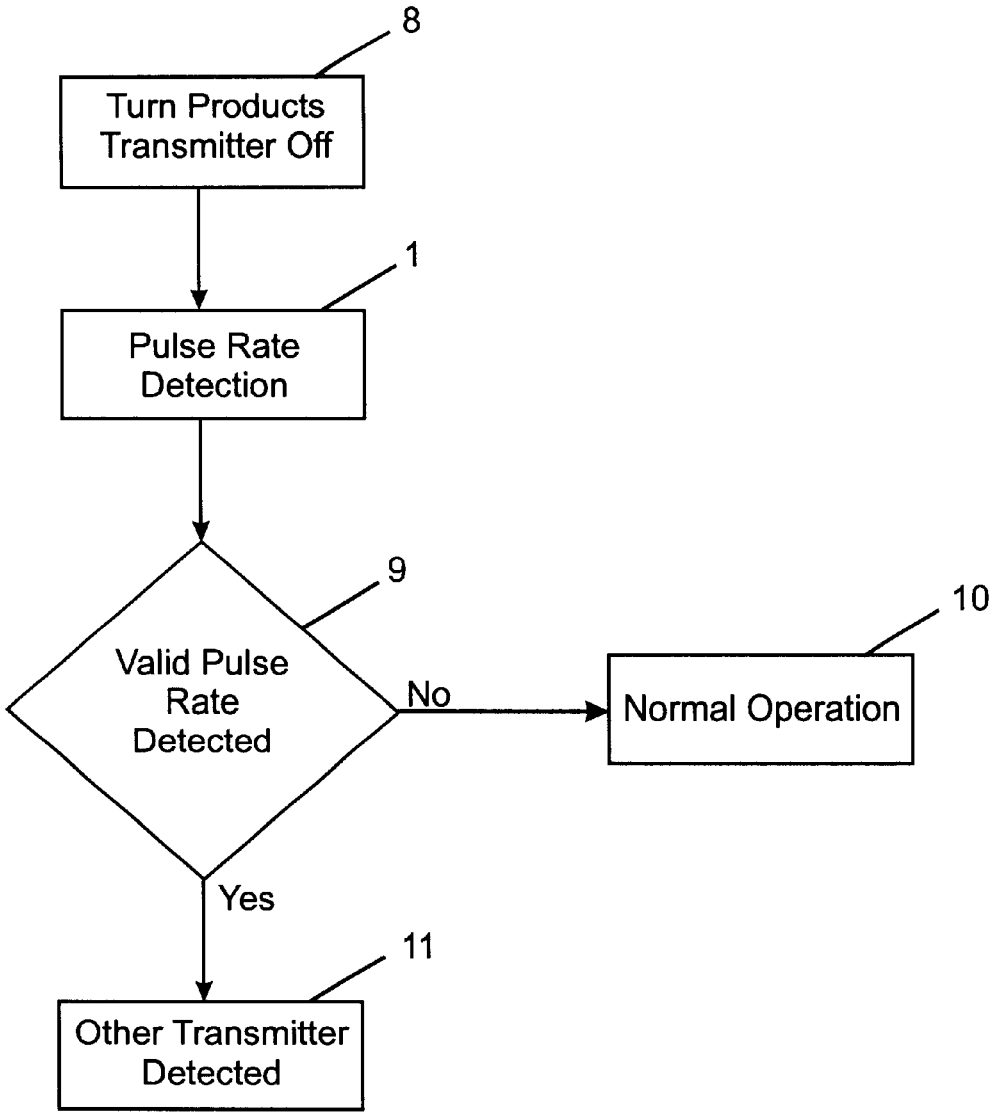
FIG. 2 is a block diagram of the source detector.

Referring to FIG. 2, after a valid pulse rate is detected the source of the signal detected must be determined, because EAS tag validations are also valid pulse rates. First, the transmitter is inhibited 8 to avoid the detection of EAS tags inside the detection field. Pulse rate detection 1, shown in FIG. 1, is used again to validate the detected signal with the transmitter inhibited. Pulse rate detection 1 is only performed for a relatively short period to confirm that the previous detection was not due to a tag. If a valid pulse rate is detected at 9, another transmitter has been detected 11 and the "auto phasing" mode will be accessed to automatically adjust the phase to the interfering transmitter. If a valid pulse is not detected at 9, the system will then return to normal operation 10.

Figure 3:
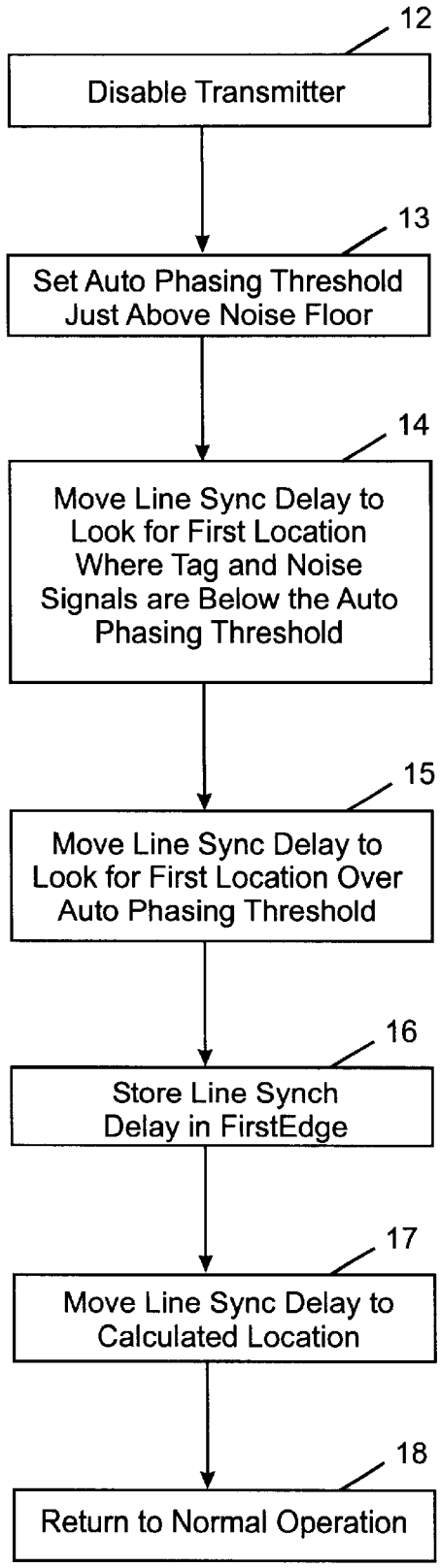
FIG. 3 is a block diagram of transmitter auto phase adjustment.

"Referring to FIG. 3, the transmitter must be inhibited 12 to avoid detecting any tags inside the detection area. After the transmitter is inhibited the auto phasing threshold is recalculated and set to just above the nominal noise level 13. To recalculate the auto phasing threshold, the threshold is reduced by about 50 mV, for example, until a valid pulse rate is detected in all three power line Phases (A, B and C), i.e., there is a valid pulse rate from 0 to 180 degrees. Then the auto phasing threshold is increased in 50 mV increments, for example, until a valid pulse rate is not detected."

To assure that a valid transmitter pulse starting edge is detected, the zero crossing delay is incremented 14 to search for the first location where a pulse rate is not detected over the auto phasing threshold. Once a quiet location is acquired, the zero crossing delay is incremented until a valid pulse rate over the auto phasing threshold is detected 15. At this point, the first edge of an adjacent transmitter has been detected and is stored 16. Throughout the detection of the transmitter edge, all pulsed noise with frequencies higher than actual transmitter pulse rates is ignored. Once the transmitter pulse edge is stored 16, the zero crossing delay is adjusted 17 so that the transmitter's pulse starting edge matches the starting edge of the adjacent EAS system transmitter that was detected. Once the phase adjustment is completed, the transmitter is enabled and normal operation is resumed 18. The transmitter is now synchronized to the adjacent transmitter that was detected.

Figure 4:
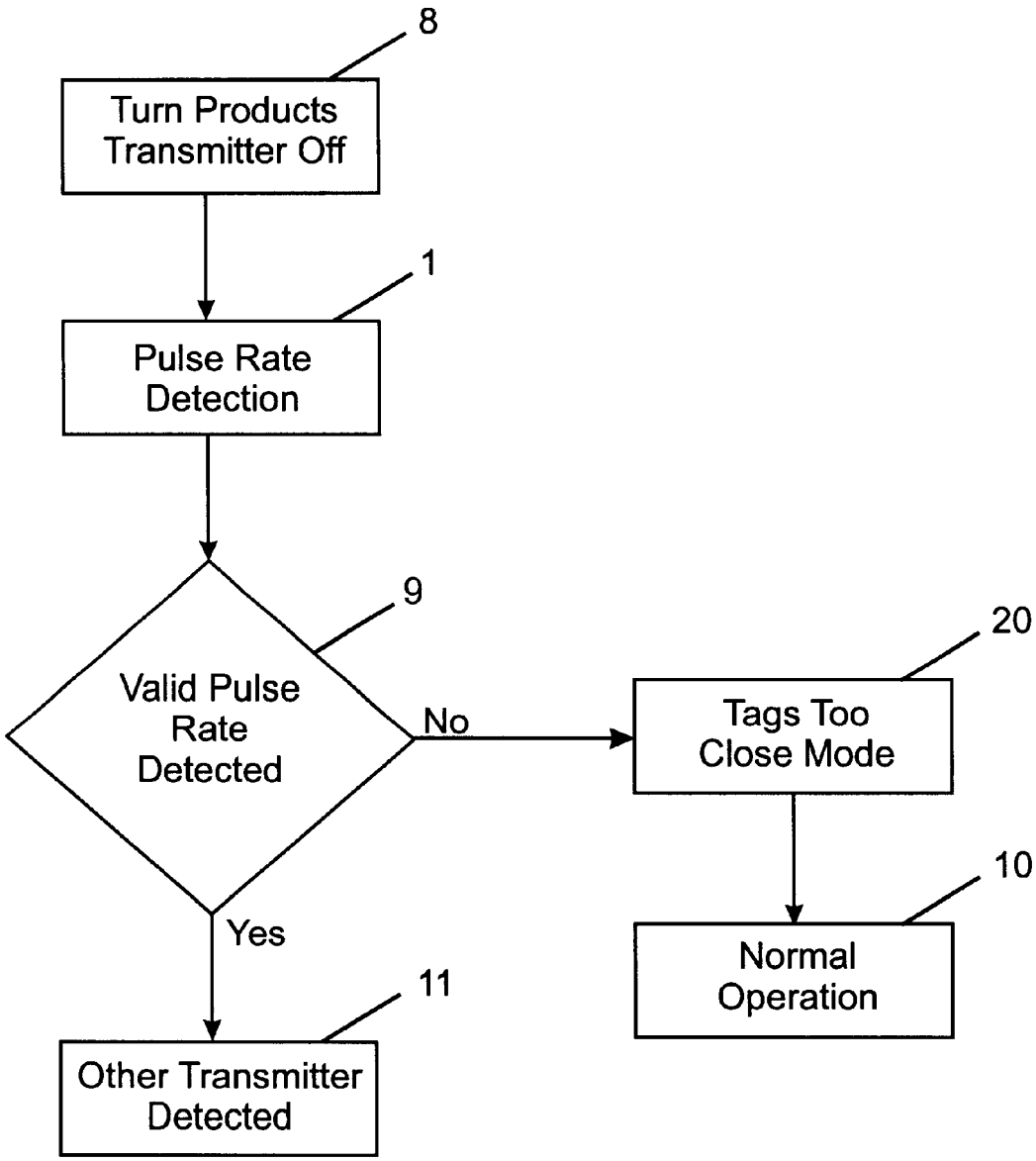
FIG. 4 is a block diagram of an alternate embodiment of the source detector shown in FIG. 2.

Referring to FIG. 4, in determining the source of the detected signal, as described above in FIG. 2, the detected signal may be from an EAS tag within or very close to the interrogation zone. If a valid pulse is not detected at 9, the detected signal is not from an EAS transmitter, and may be due to an EAS tag. This may occur if an EAS tag attached to merchandise that has been inadvertently placed too close to the interrogation zone and is responding to the EAS transmitter. The system can go into a "tags too close" mode 20, which provides a signal to indicate that the signal detected was not associated with another EAS transmitter. The signal can indicate that an EAS tag is too close to the interrogation zone, and can be used to trigger an alarm that indicates a tag is being detected in the interrogation zone. This is not a tag that is passing through the interrogation zone, but is remaining in the zone and may have been permanently placed too close. The tags too close signal can cause an alarm to be emitted for a preselected period of time. The alarm can be visual, audio, a combination, or whatever is selected to indicate that a tag is too close. The system will then return to normal operation 10.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. A method for automatic phase adjustment for synchronizing a pulsed electronic article surveillance system transmitter to an interfering transmitter, comprising:

a) detecting a signal in a preselected frequency range;

b) comparing said detected signal to a threshold value;

c) incrementing a counter value if said detected signal is greater than said threshold value;

d) comparing a timer value to a preselected sample period; and, e) if said timer value has reached said preselected sample period, comparing said counter value to a preset value and if said counter value is greater than said preset value said signal includes a valid pulse rate, wherein a portion of said detected signal is from at least one of the interfering transmitter, an electronic article surveillance tag response, or a combination thereof.

2. The method of claim 1, further comprising:

switching the pulsed electronic article surveillance system transmitter off;

repeating steps a) through e) and if said counter value is greater than said preset value said signal includes a valid pulse rate, wherein a portion of said signal is from an interfering transmitter, if said counter value is not greater than said preset value said signal does not include a valid pulse rate, wherein a portion of said signal is not from the interfering transmitter and resuming normal electronic article surveillance system operation.

3. The method of claim 2, further comprising:

switching the pulsed electronic article surveillance system transmitter off;

setting said threshold value just above a noise floor;

moving a line synchronization delay until said detected signal is below said threshold value;

moving said line synchronization delay until said detected signal is initially greater than said threshold value and wherein pulsed noise having a frequency higher than a preselected maximum transmitter pulse rate is ignored to detect a leading edge of the interfering transmitter pulse;

storing said line synchronization delay for said leading edge of the interfering transmitter pulse; and, synchronizing the pulsed electronic article surveillance system transmitter to said stored line synchronization delay and returning to normal operation.

4. The method of claim 2 further comprising generating a tags too close signal to indicate that said detected signal is due to an electronic article surveillance tag if said counter value is not greater than said preset value wherein said signal does not include a valid pulse rate, and wherein a portion of said signal is not from the interfering transmitter.

5. A system for automatic phase adjustment for synchronizing a pulsed electronic article surveillance system transmitter to an interfering transmitter, comprising:

means for detecting a signal in a preselected frequency range;

means for comparing said detected signal to a threshold value;

means for incrementing a counter value if said detected signal is greater than said threshold value;

means for comparing a timer value to a preselected sample period; and, means for comparing said counter value to a preset value, if said timer value has reached said preselected sample period, and if said counter value is greater than said preset value said detected signal includes a valid pulse rate, wherein a portion of said detected signal is from at least one of the interfering transmitter, an electronic article surveillance tag response, or a combination thereof.

6. The system of claim 5, further comprising:

means for switching the pulsed electronic article surveillance system transmitter off, and;

if said counter value is greater than said preset value said signal includes a valid pulse rate, wherein a portion of said signal is from the interfering transmitter, if said counter value is not greater than said preset value said signal does not include a valid pulse rate, wherein a portion of said signal is not from the interfering transmitter and normal electronic article surveillance system operation resumes.

7. The system of claim 6, further comprising:

means for setting said threshold value just above a noise floor, only after said pulsed electronic article surveillance system transmitter is switched off;

means for moving a line synchronization delay until said detected signal is below said threshold value;

means for moving said line synchronization delay until said detected signal is initially over said threshold value and wherein pulsed noise having a frequency higher than a preselected maximum transmitter pulse rate is ignored to detect a leading edge of the interfering transmitter pulse;

means for storing said line synchronization delay for said leading edge of the interfering transmitter pulse; and, means for synchronizing the pulsed electronic article surveillance system transmitter to said stored line synchronization delay and returning to normal operation.

8. The system of claim 6, further comprising means for generating a tags too close signal to indicate that said detected signal is due to an electronic article surveillance tag if said counter value is not greater than said preset value wherein said signal does not include a valid pulse rate, and wherein a portion of said signal is not from an interfering transmitter.

9. A method for determining if a signal detected by a pulsed electronic article surveillance system transmitter is due to an interfering transmitter or an electronic article surveillance tag, comprising:

a) detecting a signal in a preselected frequency range;

b) comparing said detected signal to a threshold value;

c) incrementing a counter value if said detected signal is greater than said threshold value;

d) comparing a timer value to a preselected sample period;

e) if said timer value has reached said preselected sample period, comparing said counter value to a preset value and if said counter value is greater than said preset value said signal includes a valid pulse rate, wherein a portion of said detected signal is from at least one of the interfering transmitter, an electronic article surveillance tag response, or a combination thereof;

f) switching the pulsed electronic article surveillance system transmitter off; and, g) repeating steps a) through e) and if said counter value is greater than said preset value said signal includes a valid pulse rate, wherein a portion of said signal is from an interfering transmitter, if said counter value is not greater than said preset value said signal does not include a valid pulse rate, wherein a portion of said signal is not from an interfering transmitter and then generating a tags too close signal to indicate that said detected signal is due to an electronic article surveillance tag, and resuming normal electronic article surveillance system operation.

10. A system for determining if a signal detected by a pulsed electronic article surveillance system transmitter is due to an interfering transmitter or an electronic article surveillance tag, comprising:

means for detecting a signal in a preselected frequency range;

means for comparing said detected signal to a threshold value;

means for incrementing a counter value if said detected signal is greater than said threshold value;

means for comparing a timer value to a preselected sample period;

means for comparing said counter value to a preset value, if said timer value has reached said preselected sample period, and if said counter value is greater than said preset value said detected signal includes a valid pulse rate, wherein a portion of said detected signal is from at least one of the interfering transmitter, an electronic article surveillance tag response, or a combination thereof; and, means for switching the pulsed electronic article surveillance system transmitter off; and, if said counter value is greater than said preset value said signal includes a valid pulse rate, wherein a portion of said signal is from the interfering transmitter, if said counter value is not greater than said preset value said signal does not include a valid pulse rate, wherein a portion of said signal is not from an interfering transmitter and further including means for generating a tags too close signal to indicate that said detected signal is due to an electronic article surveillance tag and returning to normal electronic article surveillance system operation.

* * * * *